US009452907B2

(12) United States Patent
Malinverni et al.

(10) Patent No.: US 9,452,907 B2
(45) Date of Patent: Sep. 27, 2016

(54) MANUAL DEVICE FOR APPLYING A COATING ON A MEDIUM BY MEANS OF A TAPE, THE DEVICE HAVING AN IMPROVED END PIECE

(71) Applicant: SOCIETE BIC, Clichy (FR)

(72) Inventors: Samuel Malinverni, Paris (FR); Arnaud Bez, Garches (FR); Franck Rolion, Asnieres sur Oise (FR)

(73) Assignee: Societe BIC, Clichy (FR)

( * ) Notice: Subject to any disclaimer, the term of this patent is extended or adjusted under 35 U.S.C. 154(b) by 117 days.

(21) Appl. No.: 14/350,990

(22) PCT Filed: Oct. 9, 2012

(86) PCT No.: PCT/FR2012/052287

§ 371 (c)(1),
(2) Date: Apr. 10, 2014

(87) PCT Pub. No.: WO2013/054032

PCT Pub. Date: Apr. 18, 2013

(65) Prior Publication Data

US 2014/0255078 A1 Sep. 11, 2014

(30) Foreign Application Priority Data

Oct. 10, 2011 (FR) ..... 11 59102

(51) Int. Cl.
*A45D 40/20* (2006.01)
*B65H 37/00* (2006.01)

(52) U.S. Cl.
CPC ..... *B65H 37/007* (2013.01); *B65H 37/002* (2013.01); *B65H 37/005* (2013.01)

(58) Field of Classification Search
CPC . B65H 37/007; B65H 37/002; B65H 37/005
USPC ..... 401/88; 118/76
See application file for complete search history.

(56) References Cited

U.S. PATENT DOCUMENTS 5,795,085 A 8/1998 Yoo
6,601,631 B1 * 8/2003 Miller ..... B65H 37/007 118/76

(Continued)

FOREIGN PATENT DOCUMENTS

DE 4104331 A1 8/1992
DE 42179295 A1 12/1993

(Continued)

OTHER PUBLICATIONS

International Search Report dated Jan. 21, 2013 (with English Translation) from corresponding PCT/FR2012/052287, 5 pages.

(Continued)

*Primary Examiner* — Jennifer C Chiang
(74) *Attorney, Agent, or Firm* — Ohlandt, Greeley, Ruggiero & Perle, L.L.P.

(57) ABSTRACT

A manual device for applying a coating on a medium by means of a tape, the device comprising an applicator endpiece assembled to a casing and projecting from said casing, the endpiece presenting a tongue extending along a longitudinal direction and a lateral direction, an applicator portion being formed at the distal end of the tongue, the applicator portion having an applicator edge, and a tape arranged longitudinally around the endpiece covering the tongue so as to go around the applicator portion, the width of the applicator portion being greater than the width of the tape. The width of the applicator edge is greater than or equal to the width of the tape and less than the width of the applicator portion, recesses being provided in the applicator portion in the vicinity of the lateral ends of the applicator edge, and width being measured along the lateral direction.

11 Claims, 4 Drawing Sheets

(56) References Cited

U.S. PATENT DOCUMENTS

| | | | | |
|---|---|---|---|---|
| 6,739,369 | B2 * | 5/2004 | Watanabe | B65H 37/007 118/76 |
| 7,059,374 | B2 * | 6/2006 | Mitsui | B43M 11/06 118/76 |
| 7,117,915 | B2 * | 10/2006 | Rolion | B65H 37/007 118/257 |
| 2005/0150606 | A1 | 7/2005 | Marschand et al. | |

FOREIGN PATENT DOCUMENTS

| | | | |
|---|---|---|---|
| DE | 19824948 | A1 | 12/1999 |
| EP | 0313719 | A2 | 3/1988 |
| EP | 0368070 | A2 | 10/1989 |
| EP | 0755889 | A1 | 1/1997 |
| EP | 0924150 | A1 | 6/1999 |
| EP | 0963934 | A1 | 12/1999 |
| EP | 0994060 | A1 | 4/2000 |
| EP | 1101722 | A2 | 5/2001 |
| EP | 1295834 | A1 | 3/2003 |
| EP | 1332998 | A1 | 8/2003 |
| GB | 2275042 | A | 8/1994 |
| JP | 10052995 | | 2/1998 |
| JP | 10181985 | | 7/1998 |
| JP | 10297178 | | 11/1998 |
| JP | 11157291 | | 6/1999 |
| JP | 11172213 | | 6/1999 |
| JP | 2000313197 | A | 11/2000 |
| JP | 2004009546 | A | 1/2004 |
| JP | 2004230596 | A | 8/2004 |
| JP | 2004306488 | A | 11/2004 |
| JP | 2005-288981 | A | 10/2005 |
| JP | 2005271403 | A | 10/2005 |
| JP | 2007196624 | A | 8/2007 |
| WO | 9221568 | | 12/1992 |
| WO | 9615060 | | 8/1997 |
| WO | 0117884 | A1 | 3/2001 |
| WO | 02055423 | A1 | 7/2002 |
| WO | 03004390 | A1 | 1/2003 |
| WO | 03024852 | A1 | 3/2003 |
| WO | 2005035412 | A1 | 4/2005 |
| WO | 2005035413 | A1 | 4/2005 |
| WO | 2005070798 | A1 | 8/2005 |
| WO | 2005118447 | A1 | 12/2005 |
| WO | 2007144299 | A1 | 12/2007 |
| WO | 2008078534 | A1 | 7/2008 |
| WO | 2008078535 | A1 | 7/2008 |

OTHER PUBLICATIONS

Written Opinion dated Jan. 21, 2013 from corresponding PCT/FR2012/052287, 6 pages.

* cited by examiner

MANUAL DEVICE FOR APPLYING A COATING ON A MEDIUM BY MEANS OF A TAPE, THE DEVICE HAVING AN IMPROVED END PIECE

FIELD OF THE INVENTION

The invention relates to the field of manual devices using a tape to apply a coating on a medium, and it relates more particularly to the applicator endpiece of such a device. Such devices are sometimes referred to as by the terms "mouse" or "tape applicator", and they are used particularly but not exclusively in offices. By way of example, the coating may be adhesive or it may be a white or colored coating.

STATE OF THE PRIOR ART

Known manual devices for applying a coating on a medium by means of a tape comprise an applicator endpiece assembled to a casing and projecting from said casing, the endpiece presenting a tongue extending along a longitudinal direction and a lateral direction, an applicator portion being formed at the distal end of the tongue, the applicator portion having an applicator edge, and a tape arranged longitudinally around the endpiece covering the tongue so as to go around the applicator portion.

It is often difficult to apply the coating on the medium with the help of this type of device. When using the manual applicator device, it can happen that the tape becomes twisted or else it becomes disengaged from the applicator endpiece, so that the tape no longer covers said endpiece.

By providing for the width of the applicator portion to be greater than the width of the tape, guidance is improved, but it could be improved still further. Furthermore, when several layers of coating are deposited beside one another, or one overlapping another, an applicator portion that is wider than the tape rubs against the layer of coating that has already been deposited and spoils it, thereby degrading the quality of the application of the first and second layers.

The object of the present invention is to provide a manual device for application by means of a tape, in which the endpiece provides both guidance for the tape and application quality that are improved compared with the devices described above, in particular by avoiding the above-mentioned drawbacks.

SUMMARY OF THE INVENTION

The invention provides a manual device for applying a coating on a medium by means of a tape, the device comprising an applicator endpiece assembled to a casing and projecting from said casing, the endpiece presenting a tongue extending along a longitudinal direction and a lateral direction, an applicator portion being formed at the distal end of the tongue, the applicator portion having an applicator edge, and a tape arranged longitudinally around the endpiece covering the tongue so as to go around the applicator portion, wherein the width of the applicator portion is greater than the width of the tape, and wherein the width of the applicator edge is greater than or substantially equal to the width of the tape and less than the width of the applicator portion, recesses being provided in the applicator portion in the vicinity of the lateral ends of the applicator edge, and width being measured along the lateral direction.

Naturally, the manual applicator device of the invention may equally well be of the rechargeable type or of the disposable type. If the manual device is of the rechargeable type, then the endpiece is mounted on the casing of an interchangeable cassette.

The term "tongue" is used herein to designate the portion of the applicator endpiece that extends between the applicator portion and means for assembling the applicator portion to the casing. For example, the tongue presents the general shape of a plate that is plane, curved, or made up of a plurality of plane portions that slope relative to one another. It should be observed that in a direction perpendicular to the lateral and longitudinal directions, the tongue presents a top side and a bottom side. The bottom side is the side along which the tape comes towards the applicator edge from inside the casing of the applicator device, while the top side is the side along which the tape is taken from the applicator edge towards the inside of the casing of the applicator device. It can be understood that on the bottom side, the tape carries the coating that is to be applied onto the medium, whereas on the top side the tape no longer presents this coating, since the coating has been deposited on the medium.

The applicator endpiece has an applicator portion that is wider than the tape. It can be understood that the applicator portion is formed by the distal end of the tongue that supports and guides the tape in the vicinity of the applicator edge. Thus, when the tape is moved laterally relative to the tongue (naturally to a certain extent only), because of its width, the applicator portion continues to support the tape over its entire width so that it does not become disengaged from the endpiece.

Furthermore, the applicator portion includes the applicator edge. This applicator edge constitutes that part of the applicator portion that is to co-operate with the tape for the purpose of transferring the coating from the tape onto the medium. During application of the coating on the medium, the applicator edge presses against the back face of the tape (the side of the tape that does not support the coating), thereby enabling the coating to be transferred from the front face of the tape (i.e. the side of the tape supporting the coating) onto the medium. This applicator portion presents a width that is greater than or substantially equal to the width of the tape but less than the applicator portion. The term "substantially equal" is used to mean that the width of the applicator edge may be as much as 10% less than the width of the tape. Advantageously, the width of the applicator edge may be up to 5% less than the width of the tape. Advantageously, the applicator edge presents a width that is greater than or equal to the width of the tape. Recesses are provided in the applicator portion on the bottom side of the tongue. Thus, relative to the lateral direction, the applicator edge is centered in the applicator portion, and lies between the recesses. It can thus be understood that the applicator edge lies between two recesses in the lateral direction, one setback on either side. The recesses are preferably of the same width. Thus, the sum of the widths of the two recesses plus the width of the applicator edge is equal to the width of the applicator portion. Thus, when the width of the applicator edge is increased, the width of the recesses is decreased, and vice versa.

When performing successive applications, since the width of the applicator edge is less than the width of the applicator portion, and because of the recesses, it is ensured that the part of the applicator portion that does not support the tape does not rub during said application against the coating that has already been deposited on the medium, and consequently it is ensured that it does not damage this already-deposited coating, e.g. by "scratching" it. It can be understood that the wider the recesses, the smaller the risk of damaging the already-deposited coating. The inventors have found that an applicator edge of width that is as much as 10% less than the width of the tape enables the coating to be applied in satisfactory manner on a medium, while avoiding as much as possible any risk of the coating that has already been deposited during an earlier pass being damaged. Furthermore, even when the width of the applicator edge is equal to the width of the tape, there is no risk of causing the applicator portion to rub against an already-deposited coating.

The width of the applicator edge may be greater than the width of the tape. Preferably, the width of the applicator edge is no more than 20% greater than the width of the tape. It can then be understood that in the normal position, i.e. when the tape is not shifted laterally relative to the applicator portion, the tape is centered relative to the applicator edge so that the applicator edge projects on either lateral side of the tape by the same width. Such a width for the applicator edge makes it possible to improve the quality with which the coating is applied by the applicator edge, while presenting reduced risk of any coating that has already been deposited on the medium being "scratched".

In an embodiment, the width of the applicator edge lies in the range 90% to 120% of the width of the tape. In another embodiment, the width of the applicator edge lies in the range 95% to 120% of the width of the tape. In yet another embodiment, the width of the applicator edge lies in the range 100% to 120% of the width of the tape (i.e. is equal to the width of the tape or up to 20% greater than the width of the tape).

Thus, the quality of application and of guidance of the tape are improved compared with known devices. The term "guidance" is used to mean the accuracy with which the tape is guided over the applicator endpiece and the capacity of the endpiece to limit departures of the tape from the intended path, in particular in the lateral direction, while the tape is running. The term "quality of application" is used to mean the accuracy with which the coating is deposited on the medium and also the capacity of the coating for adhering on the medium. The inventors have found that the guidance of the tape and the quality of application are interlinked.

Advantageously, a fillet is formed between the applicator edge and the wall of each recess.

A fillet constitutes rounding an edge. Thus, a fillet on a projecting connection between two walls presents a continuous convex shape between the two walls, whereas a fillet on a reentrant connection between two walls presents a continuous concave shape between the two walls.

Such a fillet avoids forming a projecting ridge that might "scratch" the tape, in particular its reverse side, thereby spoiling the layer of coating that it carries on its front side, which would spoil the deposition of the coating on the medium. This improves the quality of application of the coating on the medium. Furthermore, having a fillet softening a projecting ridge makes it possible to avoid the tape co-operating with such a projecting ridge, e.g. becoming centered on said ridge while the tape is moving and exerting a lateral friction force on the tape in such a manner as to keep the tape off-center relative to the applicator endpiece. It can thus be understood that the fillet enables a tape that has moved off-center relative to the applicator endpiece to return naturally to a centered position. Furthermore, the fillet attenuates the friction force between the lateral end of the applicator edge and the medium, thereby further attenuating the "scratching" effect, and thus avoiding spoiling the layers of coating that have already been deposited during an earlier pass. Thus, such a fillet serves both to improve guidance of the tape and to preserve layers of coating that have already been deposited.

In an embodiment, the applicator portion presents a first ridge and a second ridge extending laterally, the second ridge forming the applicator edge, the width of the first ridge being greater than the width of the second ridge. For example, the second ridge is formed by the generator line of a rounded surface (e.g. the walls of a fillet) that presses against the rear face of the tape during application on a medium. During a second pass, such a second ridge presents the advantage of not presenting a sharp projecting portion that might spoil a layer of coating that has already been deposited on the medium. Thus, regardless of the width of the applicator edge relative to the tape, such a second ridge makes it possible to improve the preservation of any coating layers that have already been deposited, while presenting application of satisfactory quality.

Advantageously, the lateral ends of the applicator portion are rounded.

In the same manner as above, the rounded lateral ends of the applicator portion serve to avoid spoiling the coating that is supported by the tape so as to improve the quality with which the coating is applied on the medium, while also improving guidance of the tape.

Advantageously, the applicator endpiece presents a top side and a bottom side relative to the tongue in the direction that is perpendicular to the lateral and longitudinal directions, sidepieces for lateral guidance of the tape extend substantially perpendicularly to the tongue on the top and bottom sides of the endpiece, the sidepieces and the tongue defining a top channel and a bottom channel for passing the tape around the endpiece.

The term "substantially perpendicular" is used to mean that the angle formed is 90° (degrees of angle) plus or minus 20° (i.e. 90°±20°). The tongue and the sidepieces define a top channel and a bottom channel for guiding the tape and they make it possible to limit or even avoid lateral departures of the tape relative to the applicator endpiece. This guide channel improves guidance of the tape, and thus improves the quality with which the coating is applied on the medium.

Advantageously, at least a portion of the bottom channel and/or of the top channel presents a width that is substantially equal to the width of the tape.

The term "substantially equal widths" is used to mean that the widths differ by no more than 10% and that the width of the channel is greater than the width of the tape. In other words, the width of the channel is equal to or slightly greater than the width of the tape. By means of the widths that are substantially equal, the amplitude of any lateral movement of the tape relative to the applicator endpiece is made small or even zero. This improves the guidance and thus the quality with which the coating is applied on the medium.

Advantageously, the two sidepieces on the top side that are laterally opposite relative to the tongue along the lateral direction support a roller, the tape being arranged between the tongue and the roller, the roller presenting a guide cylinder that is partially embedded in each of the sidepieces supporting the roller.

The roller serves to limit the movement in a vertical direction (i.e. a direction substantially perpendicular to the longitudinal direction and to the lateral direction) of the tape relative to the endpiece. This avoids the tape disengaging form the endpiece, and thus improves guidance of the tape over the endpiece. Furthermore, embedding the guide cylinder in the sidepieces makes it possible to offset the vertical join plane between the roller and the sidepieces, this join plane being parallel to the walls of the sidepieces that guide the tape laterally. Alternatively, at its lateral ends, the cylinder presents endplates extending parallel to the sidepieces. The endplates thus enable the tape to be spaced apart from the vertical join plane between the roller and the sidepieces. Either way, the tape is prevented from jamming between the roller and the sidepiece, so it is not damaged and/or it does not jam, which would prevent it from moving. This avoids spoiling the tape while improving its guidance and thus the quality with which the coating is applied on the medium.

Advantageously, in the longitudinal direction, the guide sidepieces comprise front sidepieces arranged in the vicinity of the applicator portion and rear sidepieces arranged opposite from the applicator portion relative to the front sidepieces, the front and rear sidepieces being spaced apart from one another, the tongue being flexible so that the spacing between the front and rear sidepieces varies, the portions of the front top sidepieces and/or the portions of the rear top sidepieces that are facing one another along the longitudinal direction presenting respective lateral projections constituting abutments for pressing against the facing sidepiece portion.

In order to improve the precision with which pressure is exerted by the applicator edge on the tape for better application and better guidance, the tongue is flexible and the sidepieces comprise both front sidepieces and rear sidepieces. It can be understood that the front and rear sidepieces are spaced apart by substantially vertical slots or gaps. While the tongue is bending, in order to prevent the front and rear top sidepieces from shifting laterally relative to one another and overlapping partially in the longitudinal direction, a lateral projection forms an abutment or an abutment portion so that the front sidepieces press against the rear sidepieces and prevent any undesirable deformation of the endpiece. It can thus be understood that the front sidepiece portions facing the rear sidepiece portions in the longitudinal direction, or the rear sidepiece portions facing the front sidepiece portions in the longitudinal direction, or both front and rear portions present at least one lateral projection each. Naturally, only one of the front and rear sidepieces, or else both of the front and/or rear sidepieces may present such a lateral projection. The positions of the sidepieces are thus controlled regardless of the conditions of use, so guidance is improved. Consequently, the quality with which the coating is applied on the medium is likewise improved.

Advantageously, the manual applicator device includes a top cross-member and/or a bottom cross-member extending laterally respectively between the two top sidepieces and between the two bottom sidepieces, each cross-member presenting a free edge co-operating with the tape, said free edge presenting a V-shape when seen along the longitudinal direction.

The cross-member servers to stiffen the sidepieces in bending and to preserve a substantially constant spacing between the sidepieces. The top/bottom cross-member extends transversely across the top/bottom channel formed by the sidepieces and the tongue. It can be understood that the lateral edges of the cross-member are each connected to a respective sidepiece. The edge arranged beside the tongue is preferably connected to the tongue. The edge arranged on the side remote from the tongue is free, this edge co-operating with the tape. It can be understood that the cross-member, and thus the free edge of the cross-member, are both disposed perpendicularly to the longitudinal direction, i.e. to the travel direction of the tape. Thus, while the tape is traveling when the manual device is in use, the tape rubs against the lateral edge. The V-shape of the lateral edge is preferably centered relative to the cross-member and/or relative to the channel, and/or relative to the applicator endpiece in the lateral direction. The tape is thus centered in the hollow of the V-shape, thereby improving guidance of the tape, enabling the tape to be centered, and avoiding lateral departures of the tape relative to the applicator endpiece, and thus improving the quality with which the coating is applied on the medium.

Advantageously, the tongue presents two plane portions in succession along the longitudinal direction and forming between them an angle in the longitudinal direction.

It can be understood that the tongue presents a first plane portion extending longitudinally from its proximal end, or end whereby the tongue is connected directly or indirectly to the means for assembling the applicator endpiece to the casing, and a second plane portion extending longitudinally from the first plane portion towards the distal end of the tongue. The first plane portion and the second plane portion form between them an angle, preferably an angle lying in the range 180° to 225° (degrees of angle), i.e. strictly greater than 180° and less than or equal to 225°, this angle being measured from the bottom side of the tongue. It should be observed that the value of this angle is determined as a function of the relative position of the applicator endpiece relative to the casing of the applicator device, and relative to the position of the tape. This angle of inclination of the second portion relative to the first portion enables the tape to be pressed against the second plane portion. While the tape is running, having the tape pressed in this way leads to friction forces between the tongue and the tape. These friction forces hold the tape in position against any lateral departures of the tape relative to the applicator endpiece. Thus, the guidance of the tape, and thus the quality with which the coating is applied on the support are improved.

Advantageously, the endpiece presents assembly means for assembling it to the casing, the assembly means presenting a plate for lateral guidance of the tape.

In an embodiment, the assembly means comprise a shaft for assembly to the casing, the shaft being engaged in a complementary portion of the casing, the free end of the shaft when the endpiece is assembled to the casing presenting the endplate. In another embodiment, the shaft of the assembly means is replaced by a cylindrical portion for engaging around a shaft of the casing, the cylindrical portion presenting the endplate.

The endplate serves to guide the tape and to limit its lateral movement. Thus, the guidance of the tape, and hence the quality with which the coating is applied on the medium are improved.

Each of the aspects described above contributes to improving the guidance of the tape and the quality with which the coating is applied on the medium compared with previously known manual applicator devices. It can be understood that potential combinations of some or all of these aspects leads to synergy ensuring even better guidance and quality of application.

BRIEF DESCRIPTION OF THE DRAWINGS

The invention and its advantages can be better understood on reading the following detailed description of an embodiment of the invention given by way of non-limiting example. The description is made with reference to the accompanying figures, in which.

DETAILED DESCRIPTION OF EMBODIMENTS

Figure 1:
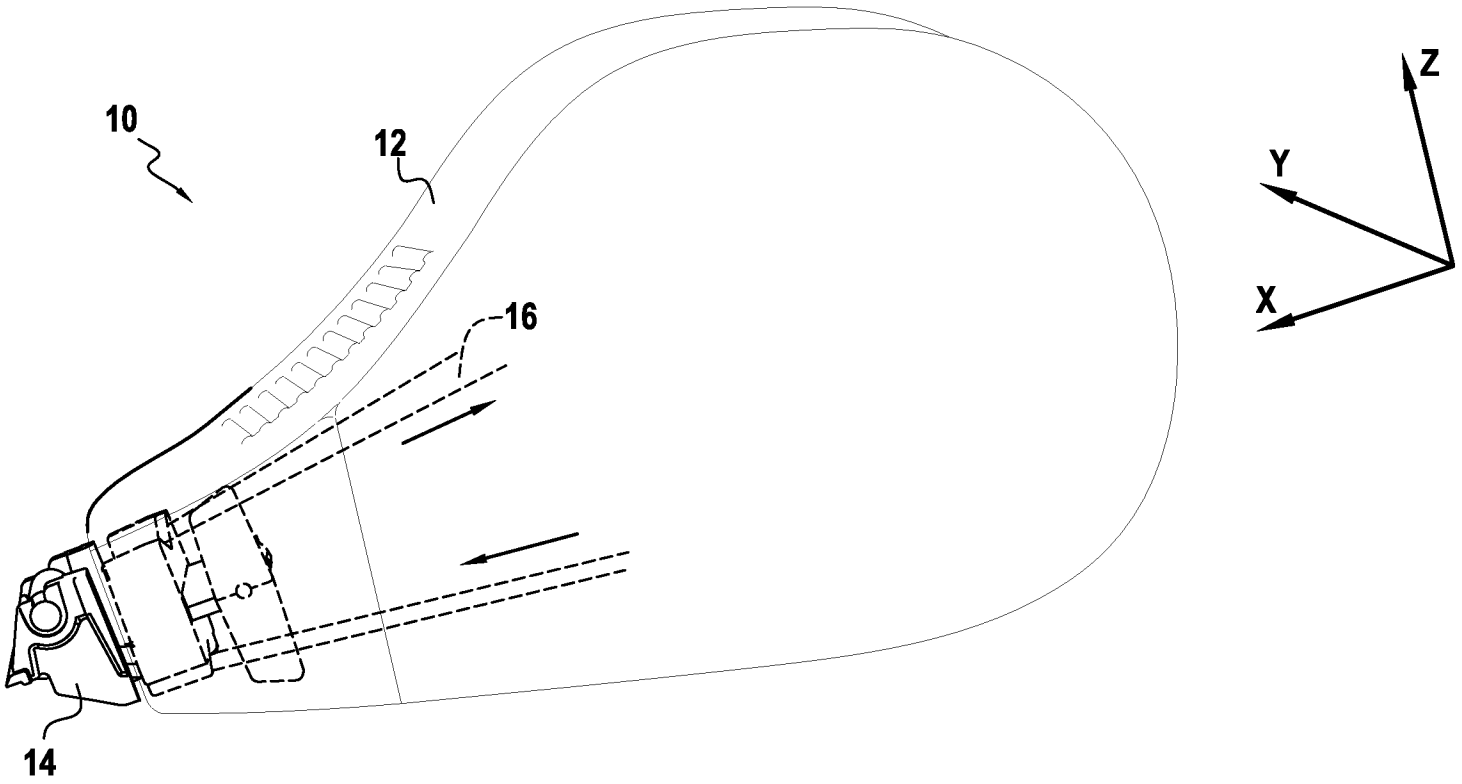
FIG. 1 shows a manual applicator device of the invention.

FIG. 1 shows a manual device 10 of the invention for applying a coating on a medium, the device being of the disposable type. The manual device 10 comprises a casing 12, an applicator endpiece 14 projecting from the casing 12, and a tape 16 extending around the endpiece 14. Arrow X represents the longitudinal direction, arrow Y represents the lateral direction, and arrow Z represents the vertical direction, these three directions being mutually perpendicular. The longitudinal and lateral directions X and Y are parallel to the plane defined by the first plane portion 140*a* of the tongue 140 described below. The bold arrows represent the travel direction of the tape 16 around the endpiece 14. The portion of the tape that is taken towards the endpiece 14 (bottom side of the endpiece) carries the coating that is to be deposited on a medium, while the portion of the tape that goes away from the endpiece (top side of the endpiece) no longer carries any coating, since the coating has already been deposited on the medium. The top side of the endpiece 14 is visible in FIGS. 2 and 7, while the bottom side of the endpiece 14 is visible in FIGS. 3 and 6.

Figure 2:
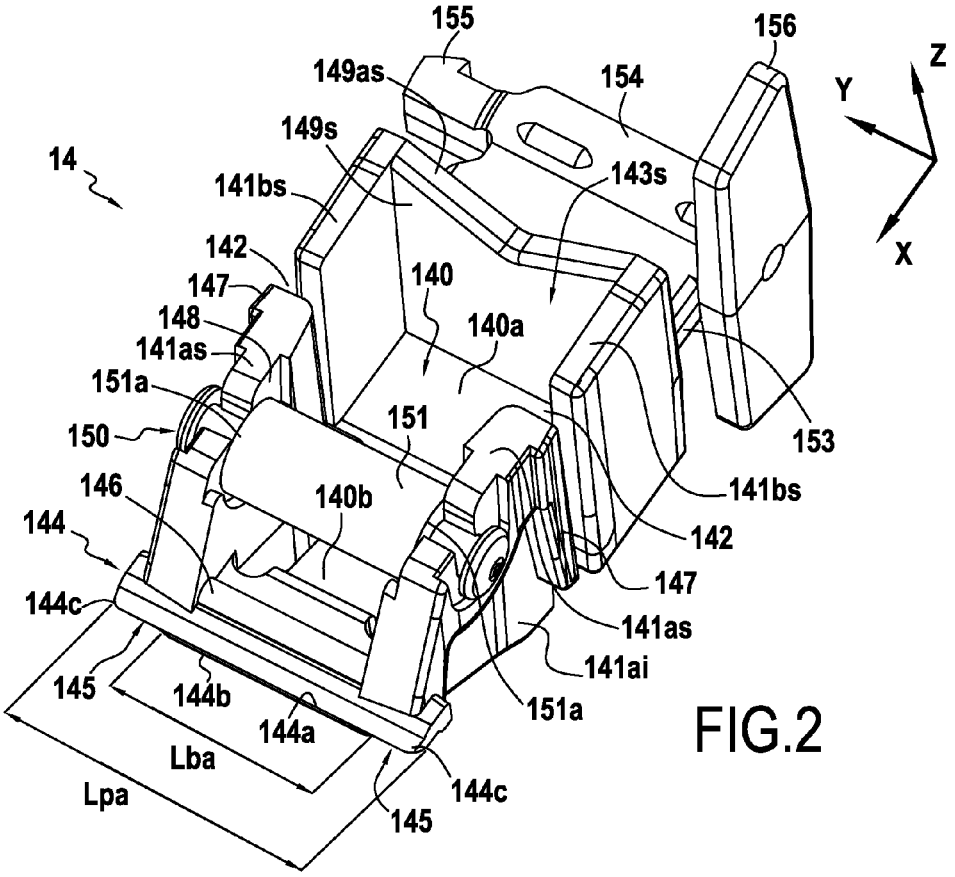
FIG. 2 shows the applicator endpiece of the FIG. 1 device seen in perspective from above.
Figure 3:
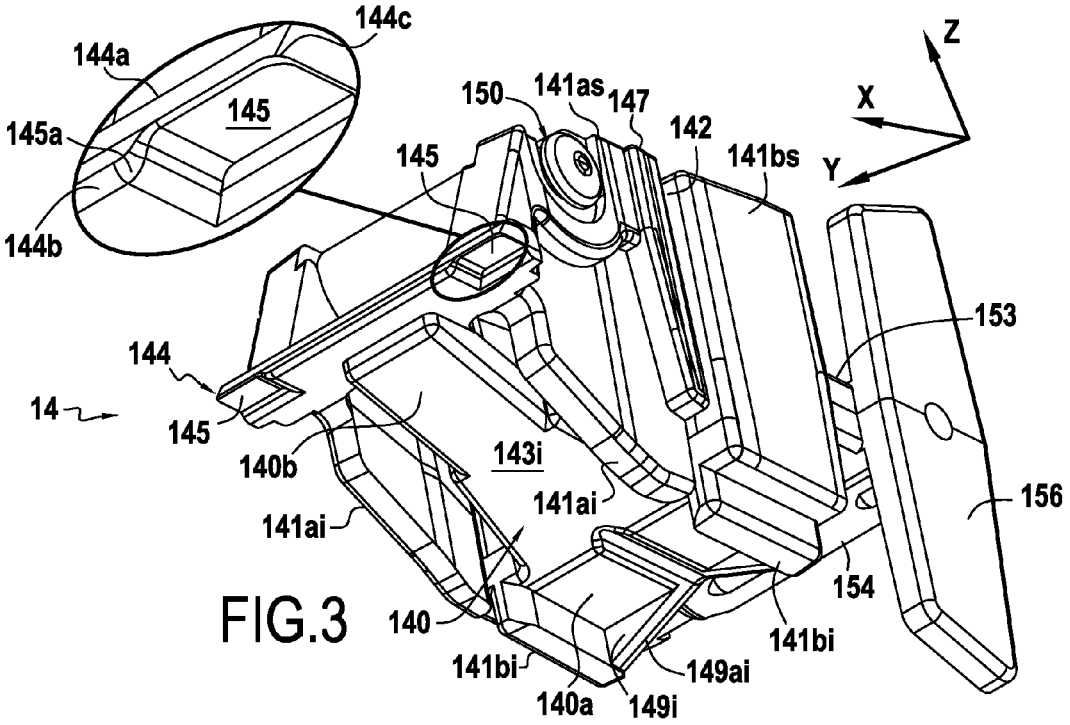
FIG. 3 shows the applicator endpiece of the FIG. 1 device seen in perspective from below.
Figure 4:
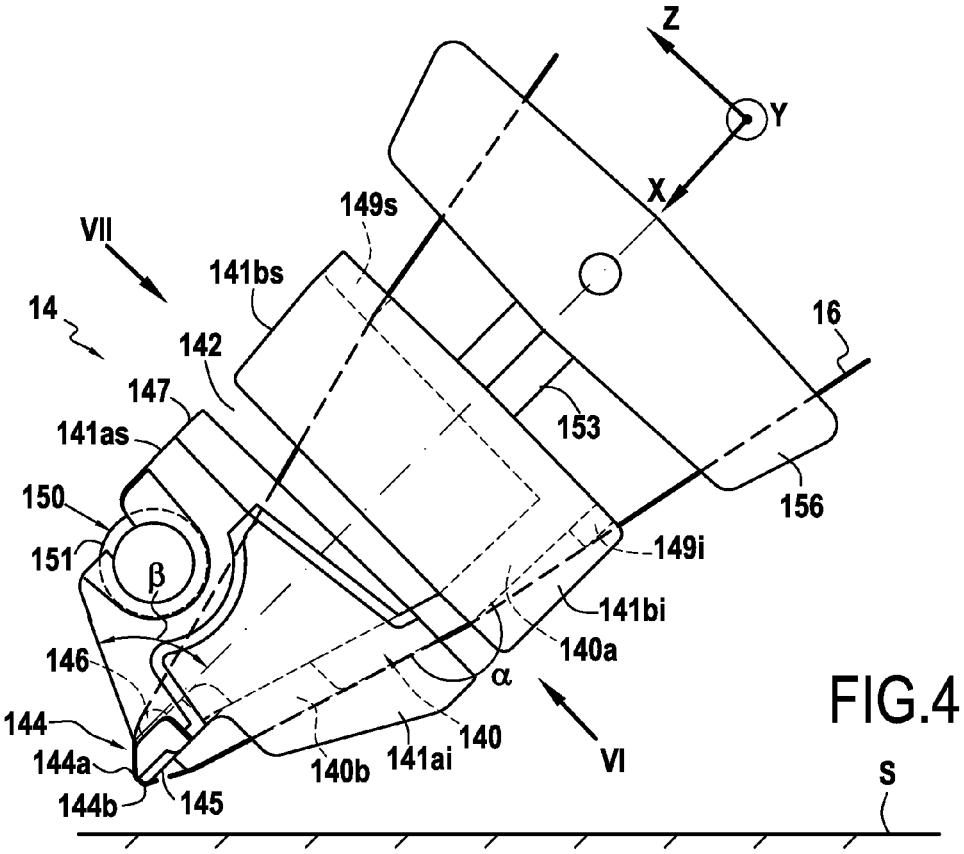
FIG. 4 is a side view of the applicator endpiece.

FIGS. 2 and 3 shows the applicator endpiece 14 on its own, while FIGS. 4 to 7 show the applicator endpiece 14 together with the tape 16. The endpiece 14 has a tongue 140. The tongue 140 has a first plane portion 140*a* and a second plane portion 140*b*. The first and second plane portions 140*a* and 140*b* are arranged in succession along the longitudinal direction X, and between them they form an angle $\alpha$ in the longitudinal direction. In this example, $\alpha$=197.5°. As shown in FIG. 4, the angle $\alpha$ is measured from the bottom side of the applicator endpiece. Naturally, this angle measurement is performed when the tongue 140 is not subjected to any external force, in particular any bending force tending to change the angle of inclination of the first portion 140*a* relative to the second portion 140*b*, or vice versa.

Figure 6:
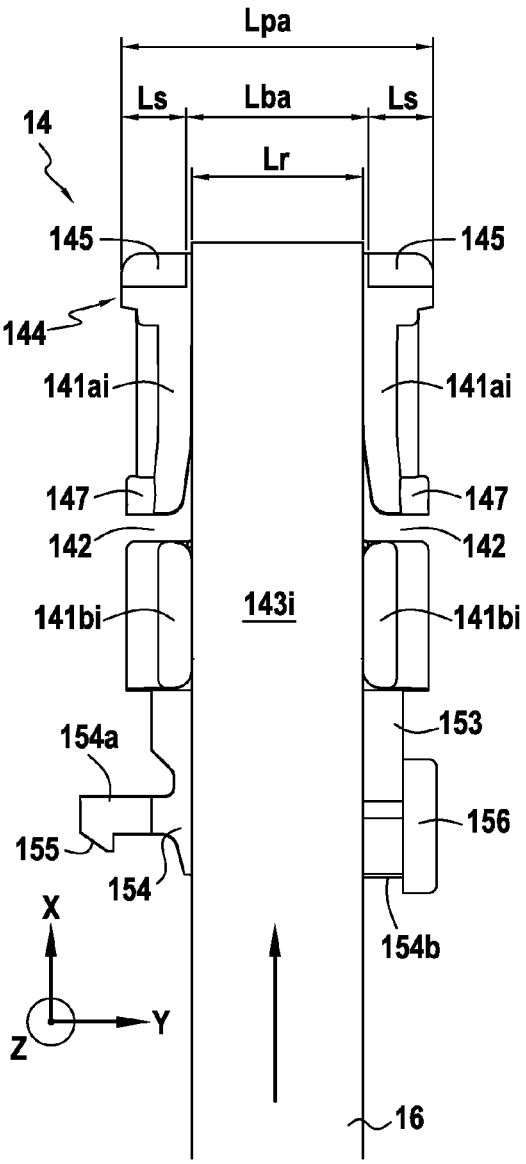
FIG. 6 shows the FIG. 4 applicator endpiece seen from below looking along arrow VI in FIG. 4.

The distal end of the tongue 140 (i.e. the free end of the tongue 140) forms an applicator portion 144. As shown in FIG. 6, the width Lpa of the applicator portion 144 is greater than the width Lr of the tape 16. In general, the ratio of the widths Lpa/Lr lies in the range 1.5 to 2.5. In this example, Lpa/Lr=2. The applicator portion 144 presents a first ridge (or top ridge) 144*a* and a second ridge (or bottom ridge) 144*b* forming an applicator edge. In this example, it should be observed that the second ridge 144*b* is formed by the generator line of a rounded edge between two intersecting walls. As shown in FIGS. 3 and 6, the width of the first ridge 144*a* is equal to the width Lpa of the applicator portion and is greater than the width Lba of the applicator edge (i.e. the second ridge) 144*b*. It should be observed that the widths are measured in the lateral direction Y.

Two recesses 145 are formed in the applicator portion 144 on the bottom side of the tongue 140 in the vicinity of the lateral ends of the applicator edge 144*b*, laterally on both sides of the applicator edge 144*b*. The applicator edge 144*b* is centered on the lateral direction Y relative to the endpiece 14 (i.e. the center of the applicator edge along the direction Y coincides with the midplane of the endpiece 14 along the direction Y). Furthermore, the recesses 145 are of equal widths, with the sum of the widths Ls of the recesses 145 plus the width Lba of the applicator edge 144*b* being equal to the width Lpa of the applicator portion 144.

In addition, the applicator portion 144 presents a transverse rib 146 in the form of a bead of semicircular section. The tape 16 co-operates with this rib 146 while it is traveling. The rib 146 serves to stiffen the applicator portion 144.

As shown in an enlarged view in FIG. 3, a fillet 145*a* is formed between the applicator edge 144*b* and the wall of the recess 145. Furthermore the lateral ends 144*c* of the applicator portion are rounded.

Two front top sidepieces 141*as*, two front bottom sidepieces 141*ai*, two rear top sidepieces 141*bs*, and two rear bottom sidepieces 141*bi* extend along the vertical direction Z. The bottom and top rear sidepieces 141*bi* and 142*bs* extend from and perpendicularly to the first plane portion 140*a* of the tongue 140. The bottom and top front sidepieces 141*ai* and 141*as* extend from and perpendicularly to the second plane FIG. 140*b* of the tongue 140. More particularly, the top and bottom front sidepieces 141*as* and 141*ai* are supported by the applicator portion 144. In this example, the bottom and top front sidepieces 141*ai* and 141*as* are made as a single piece extending vertically from one side to the other of the tongue 140, i.e. both on the bottom side and on the top side of the tongue 140. The front sidepieces 141*ai* and 141*as* are spaced apart from the rear sidepieces 141*bi* and 141*bs* by a space 142 forming a vertical slot.

As shown in FIG. 4, seen from the lateral direction Y, the front ends of the top front sidepieces 141*as* present respective rectilinear portions that are oriented substantially vertically along the direction Z and that form an angle $\beta$ lying in the range 55° to 90° with the longitudinal direction X. Such an angle makes it possible to provide better guidance for the tape, e.g. in the event of the tape floating (i.e. being slack).

The front and rear top sidepieces 141*as* and 141*bs* and the tongue 140 form a top channel 143*s* for passing the tape 16, while the front and rear bottom sidepieces 141*ai* and 141*bi* form a bottom channel 143*i* for passing the tape 16.

FIG. 6 shows the bottom side of the endpiece 14. The spacing along the lateral direction Y between the rear bottom sidepieces 141*bi* is equal to the width of the tape 16. The spacing along the lateral direction between the front bottom sidepieces 141*ai* varies in the travel direction of the tape 16 parallel to the longitudinal direction X as shown by the bold arrow: this spacing decreases until it becomes equal to the width of the tape 16. Thus, the bottom channel 143*i* presents two channel portions, namely a portion between the bottom rear sidepieces 141*bi* and a portion between the bottom front sidepieces 141*ai*, of width equal to the width of the tape 16.

Figure 7:
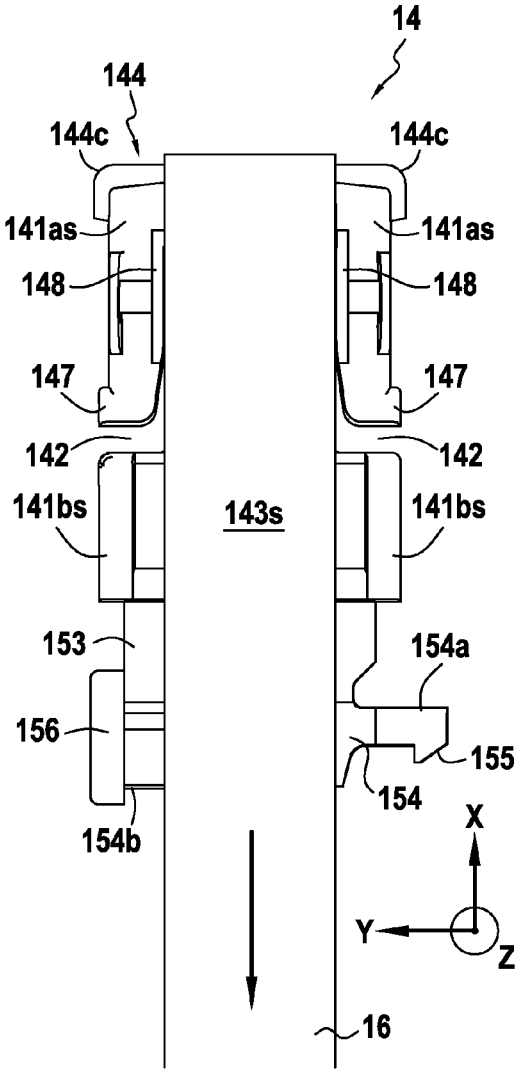
FIG. 7 shows the FIG. 4 applicator endpiece seen from above looking along arrow VII of FIG. 4.

FIG. 7 shows the top side of the endpiece 14. The spacing along the lateral direction Y between the front top sidepieces 141*as* varies in the travel direction of the tape 16, parallel to the longitudinal direction X, as shown by the bold arrow: this spacing is equal to the width of the tape 16 and then it increases. Thus, the top channel 143*s* presents a channel portion, namely a portion between the top front sidepieces 141*as*, that is of width equal to the width of the tape 16.

Figure 5:
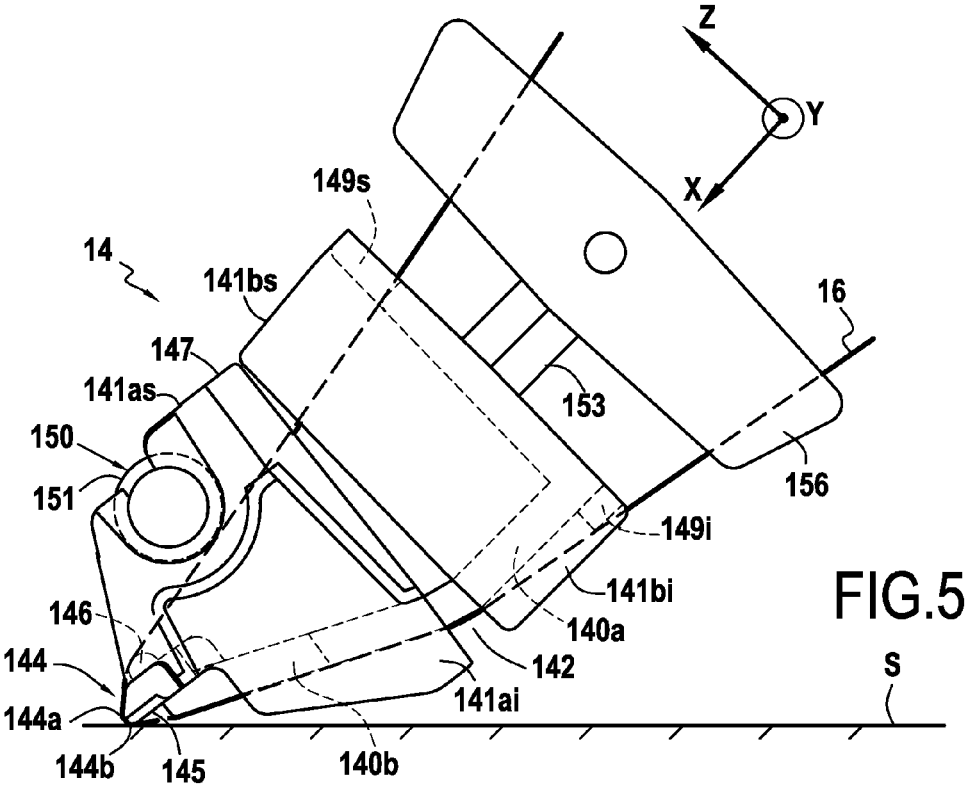
FIG. 5 shows the applicator endpiece pressed against a medium, in the same view as FIG. 4.

Each top front sidepiece 141*as* presents a lateral projection 147. These lateral projections 147 are oriented towards the outside of the applicator endpiece 14. While the manual device 10 is in use, the tongue 140 ends as shown in FIG. 5 because the endpiece 14 presses against the medium S, thereby tending to bring the front top sidepieces 141*as* and the projections 147 to press against the facing portions of the rear top sidepieces 141*bs*, thereby blocking bending of the tongue 140 and preventing the front and rear top sidepieces 141*as* and 141*bs* from overlapping in the longitudinal direction X.

The top front sidepieces 141*as* support a roller 150 presenting a guide cylinder 151. As shown in FIGS. 4 and 5, the tape 16 passes between the tongue 140 and the cylinder 151 of the roller 150. It should be observed that FIG. 7 does not show the roller 150, only the cutouts for clip-fastening the roller 150 that are provided in the sidepieces 141*ai* being shown. The cylinder 151 is a subportion of the roller 150. The roller 150 may be made as a single part, or else the cylinder 151 may be a part that is separate and that is engaged on a roller shaft, the shaft and the cylinder together forming the roller 150.

The two top front sidepieces 141*as* present respective cutouts 148 (cf FIGS. 2 and 7) receiving the lateral ends 151*a* of the cylinder 151, the cylinder thus being partially embedded within these two sidepieces 141*as* supporting the roller 150. Thus, the vertical join planes extending in the longitudinal direction X between the lateral ends 151*a* of the cylinder 151 and the sidepieces 141*as* are laterally offset relative to the portions of the sidepiece walls 141*as* that guide the tape 16 laterally.

A bottom cross-member 149*i* and a top cross-member 149*s* extend transversely respectively between the rear bottom sidepieces 141*bi* and the rear top sidepieces 141*bs*. These cross-members 149*i* and 149*s* are arranged in a common vertical plane at the rear of the rear sidepieces 141*bi* and 141*bs*, the fronts being defined by the applicator portion 144 (and the rear thus being the side opposite from the front). The free edges 149*ai* and 149*as* of the bottom and top cross-members 149*i* and 149*s* respectively present a V-shape when the cross-members are seen looking along the longitudinal direction X, the bottom of the V-shape pointing towards the tongue 140. It should be observed that the bottom of the V-shape of the free edge 149*ai* of the bottom cross-member 149*i* is extended longitudinally in the first plane portion 140*a* of the tongue 140. Thus, a V-shaped longitudinal groove formed in the first plane portion 140*a* of the tongue 140 is arranged in line with the V-shape of the free edge 149*ai* of the bottom cross-member 149*i* along the longitudinal direction X.

The top cross-member 149*s* is connected to a flat junction piece 153 arranged parallel to the longitudinal and lateral directions X and Y and extending towards the rear of the endpiece 14. On its side opposite from the cross-member 149*s*, this junction piece 153 is connected to an assembly shaft 154 which extends along the lateral direction Y. The assembly shaft 154 and the flat junction piece 153 form the means for assembling the endpiece 14 to the casing 12 of the manual device 10.

A lateral end 154*a* of the shaft 154 presents a hook 155 to lock the assembly of the endpiece 14 to the casing 12. The shaft 154 is engaged in a complementary portion (not shown) of the casing 12, and the hook 155 co-operates with this complementary portion to lock the assembly of the endpiece 14 to the casing 12. When the endpiece 14 is assembled to the casing 12, the other end 154*b* of the shaft 154 remains free. This free end carries a guide plate 156 for guiding the tape 16, this guide plate limiting lateral movement of the tape 16.

Naturally, in an alternative, the endpiece 14 presents means for assembling to the casing 12 that are different from those described above. In yet another alternative, the endpiece 14 does not present a guide plate 156.

In this example, the applicator endpiece 14 is made integrally by injection molding. The roller 150 is then assembled to the endpiece 14 by being clipped thereto. The endpiece 14 and the roller 150 are made of plastics material. By way of example, the endpiece 14 and/or the roller 150 are made of polypropylene (PP), of polyoxymethylene (POM), or of polyethylene (PE). Advantageously, the roller 150 is made of a material that is different from the endpiece 14, in order to avoid or to limit friction wear phenomena. For example, the roller 150 may be made of polyoxymethylene while the endpiece 14 may be made of polypropylene.

The invention claimed is:

1. A manual device for applying a coating on a medium by a tape, the device comprising: an applicator endpiece assembled to a casing and projecting from said casing, the endpiece presenting a tongue extending along a longitudinal direction and a lateral direction, an applicator portion being formed at the distal end of the tongue, the applicator portion having an applicator edge and a tape arranged longitudinally around the applicator endpiece covering the tongue to go around the applicator portion, a width of the applicator portion being greater than a width of the tape, a width of the applicator edge being greater than or substantially equal to the width of the tape and less than the width of the applicator portion, recesses being provided in the applicator portion adjacent to or at the lateral ends of the applicator edge, wherein the width of the applicator portion, the width of the tape, and the width of the applicator edge are measured along the lateral direction.

2. A manual device according to claim 1, further comprising a fillet that is formed between the applicator edge and a wall of each of the recesses.

3. A manual device according to claim 1, wherein the applicator portion presents a first ridge and a second ridge extending laterally, the second ridge forming the applicator edge, a width of the first ridge being greater than a width of the second ridge.

4. A manual device according to claim 1, wherein the lateral ends of the applicator portion are rounded.

5. A manual device according to claim 1, wherein the tongue presents two plane portions in succession along the longitudinal direction and forming between them an angle in the longitudinal direction.

6. A manual device according to claim 1, wherein the endpiece presents assembly means for assembling it to the casing, the assembly means presenting a plate for lateral guidance of the tape.

7. A manual device for applying a coating on a medium by a tape, the device comprising: an applicator endpiece assembled to a casing and projecting from said casing, the endpiece presenting a tongue extending along a longitudinal direction and a lateral direction, an applicator portion being formed at the distal end of the tongue, the applicator portion having an applicator edge and a tape arranged longitudinally around the applicator endpiece covering the tongue to go around the applicator portion, a width of the applicator portion being greater than a width of the tape, a width of the applicator edge being greater than or substantially equal to the width of the tape and less than the width of the applicator portion, recesses being provided in the applicator portion in the vicinity of lateral ends of the applicator edge, wherein the width of the applicator portion, the width of the tape, and the width of the applicator edge are measured along the lateral direction, wherein the applicator endpiece presents a top side and a bottom side relative to the tongue in a direction that is perpendicular to the lateral and longitudinal directions, sidepieces for guiding the tape and extending substantially perpendicularly to the tongue are on the top and bottom sides of the endpiece, the sidepieces and the tongue defining a top channel and a bottom channel for passing the tape around the endpiece.

8. A manual device according to claim 7, wherein at least a portion of the bottom channel and/or of the top channel presents a width that is substantially equal to the width of the tape.

9. A manual device according to claim 7, wherein two of the sidepieces on the top side that are laterally opposite relative to the tongue along the lateral direction support a roller, the tape being arranged between the tongue and the roller, the roller presenting a guide cylinder that is partially embedded in each of the two sidepieces supporting the roller.

10. A manual device according to claim 7, wherein, in the longitudinal direction, guide sidepieces of the sidepieces comprise front sidepieces arranged in the vicinity of the applicator portion and rear sidepieces arranged opposite from the applicator portion relative to the front sidepieces, the front and rear sidepieces being spaced apart from one another, the tongue being flexible so that a spacing between the front and rear sidepieces varies, portion of the front top sidepieces of the front sidepieces and/or portion of the rear top sidepieces of the rear sidepieces that are facing one another along the longitudinal direction present respective lateral projections constituting abutments for pressing against the facing sidepiece portion.

11. A manual device according to claim 7, further comprising a top cross-member and/or a bottom cross-member extending laterally respectively between two top sidepieces of the sidepieces and between two bottom sidepieces of the sidepieces, each of the top cross-member and the bottom cross-member presenting a free edge co-operating with the tape, said free edge presenting a V-shape when seen along the longitudinal direction.

* * * * *